US006346022B1

(12) United States Patent
Swanby et al.

(10) Patent No.: US 6,346,022 B1
(45) Date of Patent: Feb. 12, 2002

(54) REVERSIBLE INFLATABLE PERSONAL FLOTATION DEVICE

(75) Inventors: Scott P. Swanby, Boise; Allen J. Van Camp, Fruitland, both of ID (US)

(73) Assignee: Sporting Lives, Inc., Fruitland, ID (US)

( * ) Notice: Subject to any disclaimer, the term of this patent is extended or adjusted under 35 U.S.C. 154(b) by 0 days.

(21) Appl. No.: 09/656,233

(22) Filed: Sep. 6, 2000

(51) Int. Cl.[7] ..... B63C 9/08
(52) U.S. Cl. ..... 441/106; 441/117
(58) Field of Search ..... 441/88, 92, 99, 441/106, 111, 117

(56) References Cited

U.S. PATENT DOCUMENTS 4,498,882 A 2/1985 Evert ..... 441/116
4,865,573 A * 9/1989 Switlik, Jr. et al. ..... 441/92
5,746,633 A 5/1998 Jeffrey ..... 441/123
5,911,612 A 6/1999 Steger ..... 441/118

* cited by examiner

*Primary Examiner*—Jesus D. Sotelo
(74) *Attorney, Agent, or Firm*—Ormiston & McKinney, PLLC

(57) ABSTRACT

An inflatable personal flotation device that is reversible and comparatively easily to put on and secure even under difficult conditions. The device can be donned and worn with either side to the front. The personal flotation device of the present invention uses a harness rather than a belt to secure the device in place on the user. The harness preferably also includes a keeper configured to locate the strap always within reach of the user once the device is slipped over the user's head to make it easier to buckle the harness to secure the device. The reversible nature of the invention allows the user to don the device without having to contemplate which way the device should be oriented.

17 Claims, 10 Drawing Sheets

REVERSIBLE INFLATABLE PERSONAL FLOTATION DEVICE

FIELD OF THE INVENTION

The invention relates generally to a personal flotation device, and more particularly, to a reversible inflatable personal flotation device.

BACKGROUND

The personal flotation device of the present invention was developed in an effort to provide a high performance user friendly reversible inflatable personal flotation device. Many conventional wearable flotation devices work well if they are worn at all times. Many of these same devices, however, are hard to put on and even harder to secure properly, particularly in an emergency. The inflatable flotation device shown and described in the Steger patent, U.S. Pat. No. 5,911,612, illustrates some of the problems with conventional U-shaped inflatable and foam personal flotation devices. The Steger device includes a U-shaped buoyancy chamber that extends from a right side chest portion, along a collar portion around behind the user's head, to a left side chest portion. The device is donned by slipping the collar portion over and behind the user's head and secured with a waist belt. Such devices also usually include a tie or buckle that hold the chest portions together. The Steger device, like other conventional U-shaped devices, can only be worn in one orientation—they are not reversible—and a loose hanging waist belt must be grasped and handed around behind the user's mid-section and buckled in front. Donning such a device in an emergency, while in the water or in the dark or under any combination of these conditions may be very difficult.

SUMMARY

Accordingly, the present invention is directed to an inflatable personal flotation device that is reversible and comparatively easily to put on and secure even under difficult conditions. The device can be donned and worn with either side to the front. The personal flotation device of the present invention uses a harness rather than a belt to secure the device in place on the user. The harness preferably also includes a keeper configured to locate the strap always within reach of the user once the device is slipped over the user's head to make it easier to buckle the harness to secure the device. The reversible nature of the invention allows the user to don the device without having to contemplate which way the device should be oriented. This feature can save time in an emergency situation and the user will have less opportunity to panic. Also, if visibility is a problem, the user can still put the device on without worrying about the correct orientation.

In one embodiment of the invention, the harness includes a first strap fastened at one end to the collar of the inflatable bladder and a second strap operatively connected to the first strap at a point generally between the user's shoulder blades when the device is being worn and the bladder is uninflated. The second strap extends from the bottom of the chest portion of the bladder up to the first strap and back down to the bottom of the chest portion of the bladder. In one preferred version of this embodiment, the first strap is fastened to the collar of the bladder at a location that lies substantially on a centerline that divides the torso of the user into left and right sides and both straps are fastened to the bladder at locations generally within a plane that extends through the edge perimeter of the bladder.

In one embodiment, the inflator used to inflate the bladder includes two cartridges of compressed gas disposed on opposite sides of the bladder. A user operated cartridge firing mechanism is operatively coupled between each cartridge and the bladder. The firing mechanisms are operable between a first position in which gas is retained in the cartridge and a second position in which gas is expelled from the cartridge into the bladder. A grab handle is coupled to each firing mechanism for activating the firing mechanism to move from the first position to the second position. Each grab handle is located adjacent to the bladder generally in a plane that extends through the edge perimeter of the bladder so that the grab handles are in the same location without regard to the orientation of the device on the user.

In one embodiment of the invention, the bladder includes a flexible joint between the collar and the adjoining chest portions of the bladder. The collar moves back and forth when the device is inflated between a first position in which the joint flexes in a first direction and the collar tilts to one side and a second position in which the joint flexes in a second direction and collar tilts to the other side. In one preferred version of this embodiment, the joint is formed by a localized narrow region across the bladder at the transition between the collar and chest portions of the bladder. The localized narrow region is formed, for example, by comparatively small rounded indentations in the outside perimeter of the bladder.

The foregoing summary is not intended to be an inclusive list of all aspects and features of the invention nor should any limitation on the scope of the invention be implied from this summary. The summary is provided in accordance with the requirements of 37 C.F.R. §1.73 and the Manual of Patent Examining Procedure (MPEP) 608.01(d) merely to apprise the public of the nature of the invention.

BRIEF DESCRIPTION OF THE DRAWINGS

FIG. 7A shows the collar tilted back to the left. FIG. 7B shows the collar tilted back to the right

DETAILED DESCRIPTION

Figure 1:
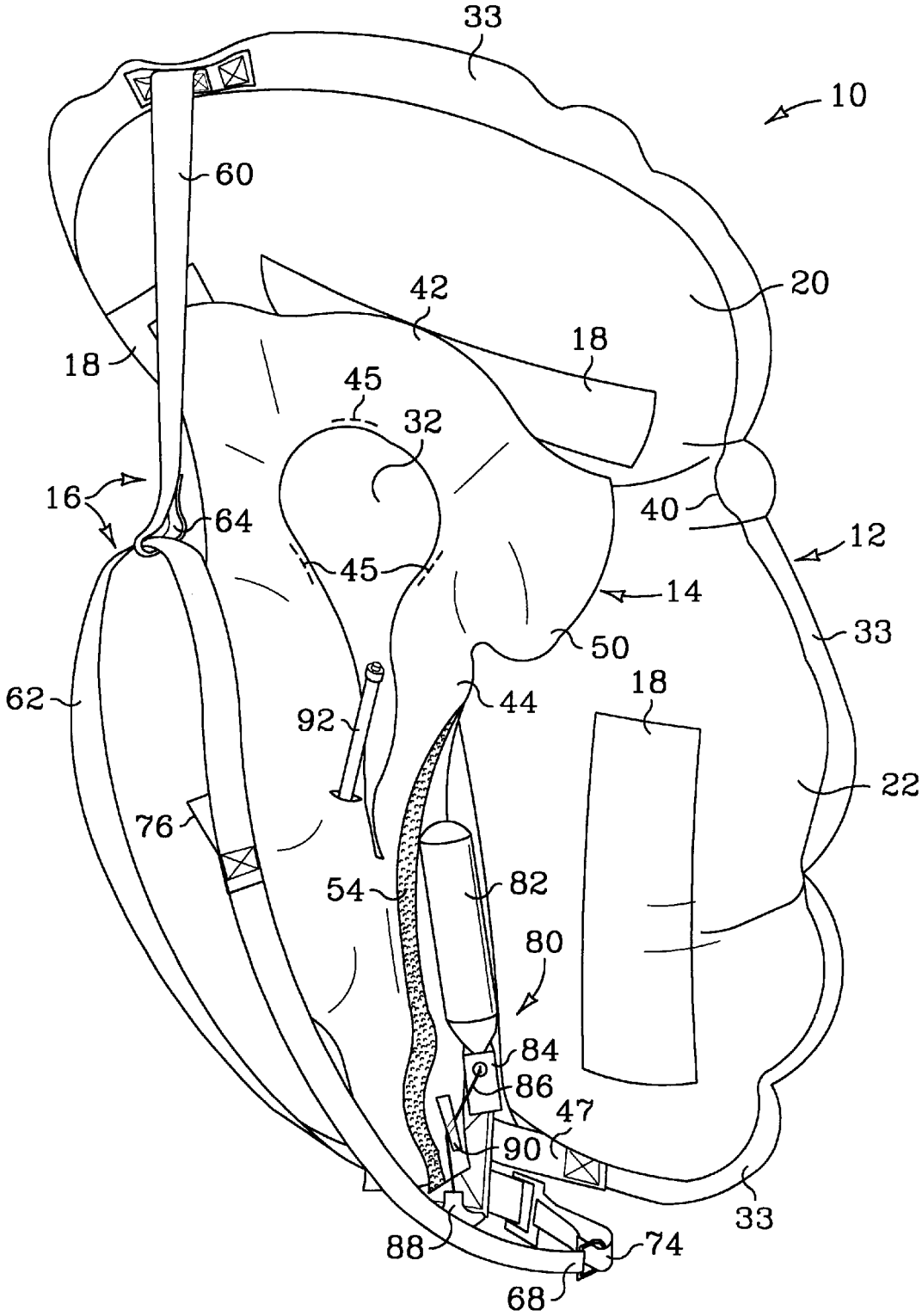
FIG. 1 is a perspective view of one embodiment of the personal flotation device of the present invention with the inflatable bladder inflated.
Figure 2:
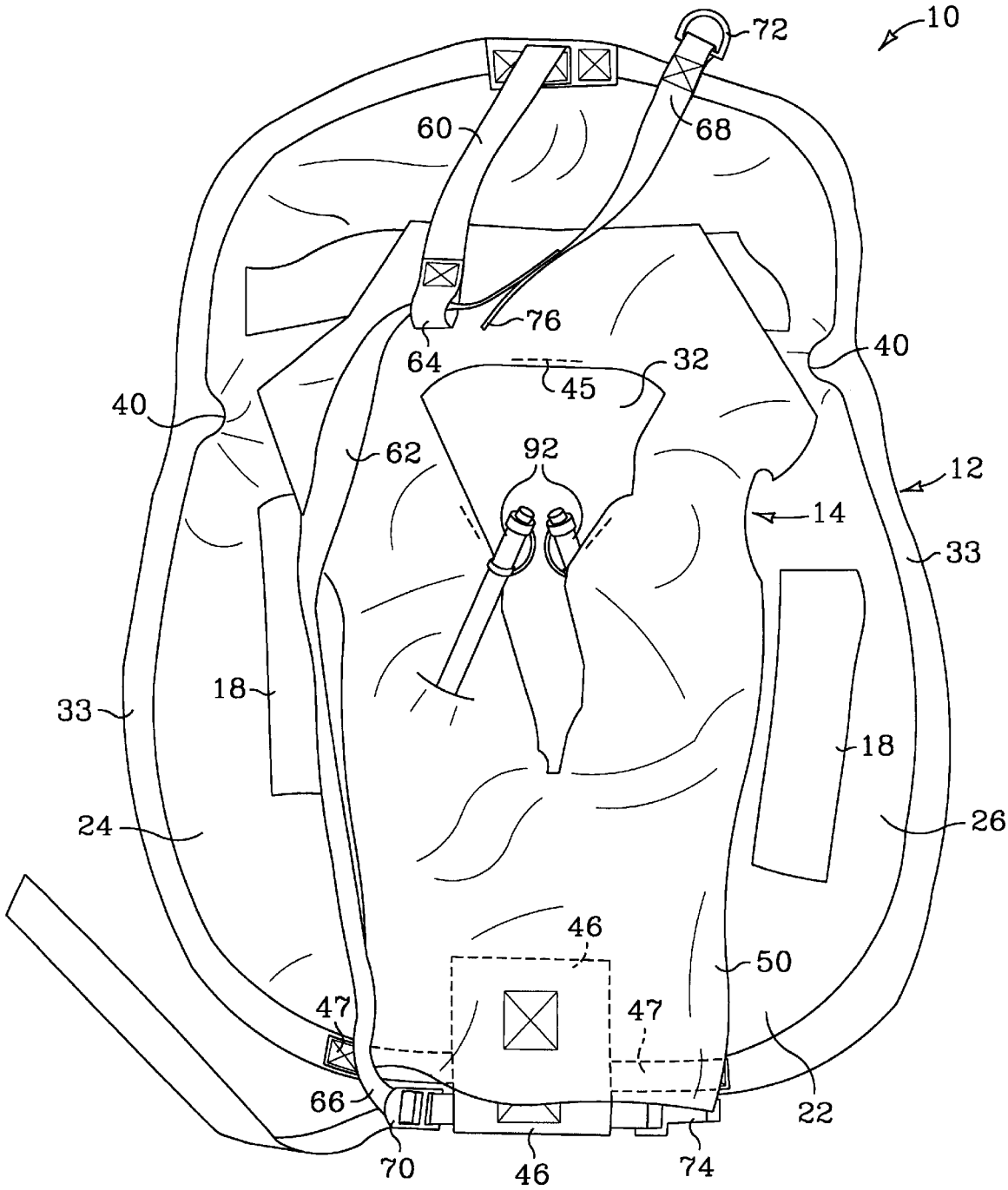
FIG. 2 is an elevation view of the personal flotation device of FIG. 1 uninflated showing the inflatable bladder pulled out of the cover.

FIGS. 1 and 2 illustrate some of the primary features of the presently preferred embodiment of the invention. In FIG.

1, personal flotation device 10 is inflated. In FIG. 2, personal flotation device 10 is uninflated but pulled out from the cover so the buoyancy bladder 12 is visible. Referring to FIGS. 1 and 2, device 10 includes a generally U-shaped inflatable buoyancy bladder 12, cover 14 and harness 16. Strips of reflective material 18 are typically affixed to the outside of bladder 12. If necessary or desirable for the conditions under which it is expected the device will be used, blinking lights, transmitters and other safety features may be incorporated into device 10.

Figure 9:
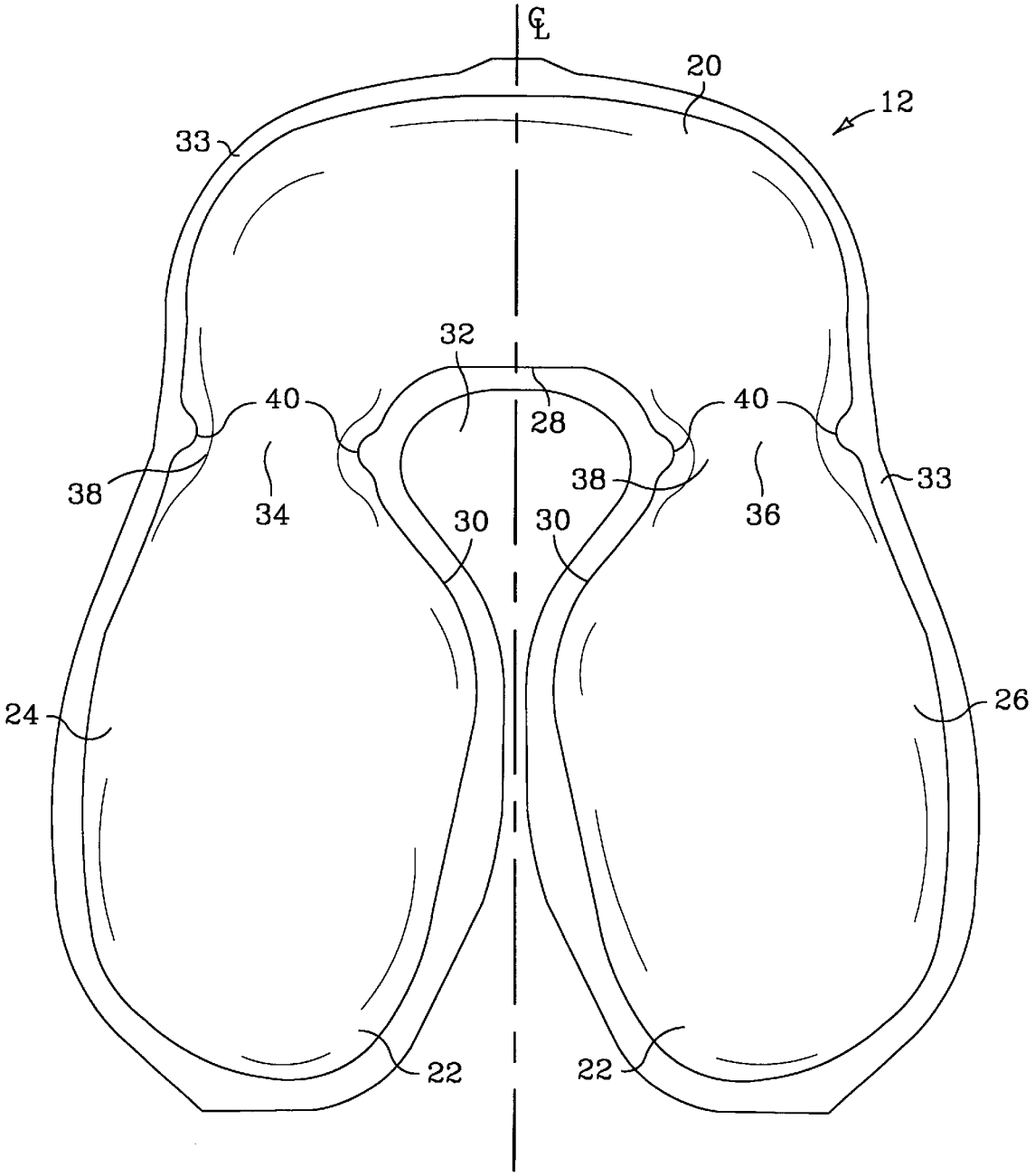
FIG. 9 is an elevation view of an inflatable bladder used in one embodiment of the invention.

Bladder 12 is shown in more detail in FIG. 9. Referring to FIGS. 1, 2 and 9, bladder 12 includes a collar 20 and an adjoining chest portion 22. Collar 20 fits around and behind the user's head and neck when device 10 is being worn. Chest portion 22 extends down from collar 20 generally over the user's chest and mid-section when device 10 is being worn. In this embodiment, chest portion 22 consists of two separate side panels 24 and 26 that form the legs of the U-shaped bladder 12. Other configurations are possible, however. For example, the chest portion of bladder 12 could be constructed as a single chamber extending fully across the width of the bladder. Alternatively, a generally ring shaped bladder might be used in which the chest side panels are connected through a buoyancy chamber disposed opposite the collar along the bottom of the bladder. Also, although separate chambers could be used for collar 20 and one or both chest panels 24 and 26, a single chamber is preferred so that only one inflator is needed to inflate all of bladder 12.

Both sides of bladder 12 are substantially identical. That is to say, the functional features of bladder 12 are the same across both sides.

Referring specifically to FIG. 9, the inside perimeter 28 of collar 20 and the inside perimeter 30 of the top of chest panels 24, 26 define an opening 32. When bladder 12 is uninflated, the user can slip her head through opening 32 to don device 10. When bladder 12 is inflated, opening 32 narrows to fit more closely around the user's neck. To facilitate attaching other components to bladder 12, a flange 33 is formed at least at any such attachment points around bladder 12. For ease of construction, flange 33 is formed all around bladder 12 as shown in FIG. 9. Inflatable bladders like bladder 12 are usually formed by overlaying two layers of air tight materials and then sealing the materials together in the desired size and shape. This seal is often formed by heat sealing the materials together. Flange 33 can be formed simply by leaving a bit of extra material outside the seal when excess material is cut from the bladder.

Figure 7B:
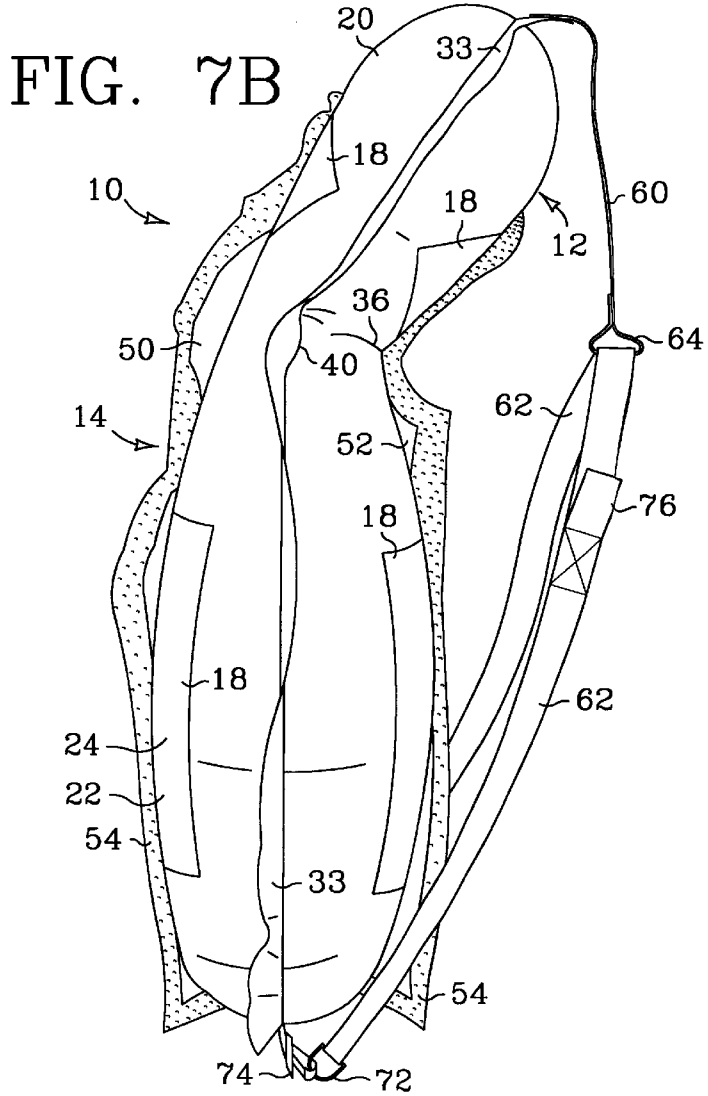
FIGS. 7A and 7B are a side elevation views of the personal flotation device of FIG. 1.
Figure 7A:
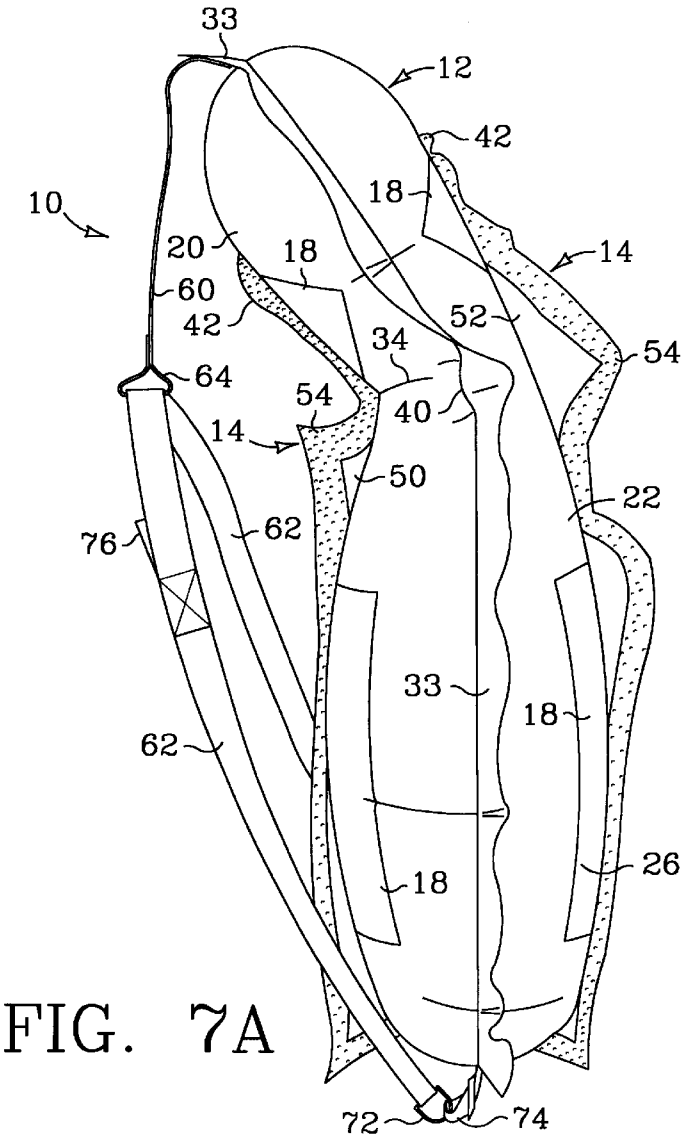

Joints 34 and 36 are formed in bladder 12 at the transition areas 38 between collar 20 and chest panels 24, 26 respectively. As seen by comparing FIGS. 7A and 7B, joints 34 and 36 allow collar 20 to tilt back one way or the other to accommodate the orientation in which device 10 is worn. Tilting collar 20 back places more of the bladder in the water behind the user's head which, in turn, holds the head further above the water. In the embodiment of bladder 12 shown in the Figures, joints 34 and 36 are formed by narrowing bladder 12 at transition areas 38. This is accomplished, for example, by indenting the perimeter of bladder 12. Comparatively small rounded indentations 40 are preferred to help maintain the strength of the bladder's sealed perimeter and to minimize the adverse effects overpressurizing bladder 12. The narrowed transition area creates a comparatively weak line across the fabric structure of bladder 12. This weak line acts as a joint to allow collar 20 to be tilted to one side or the other relative to chest panels 34 and 36.

Figure 3:
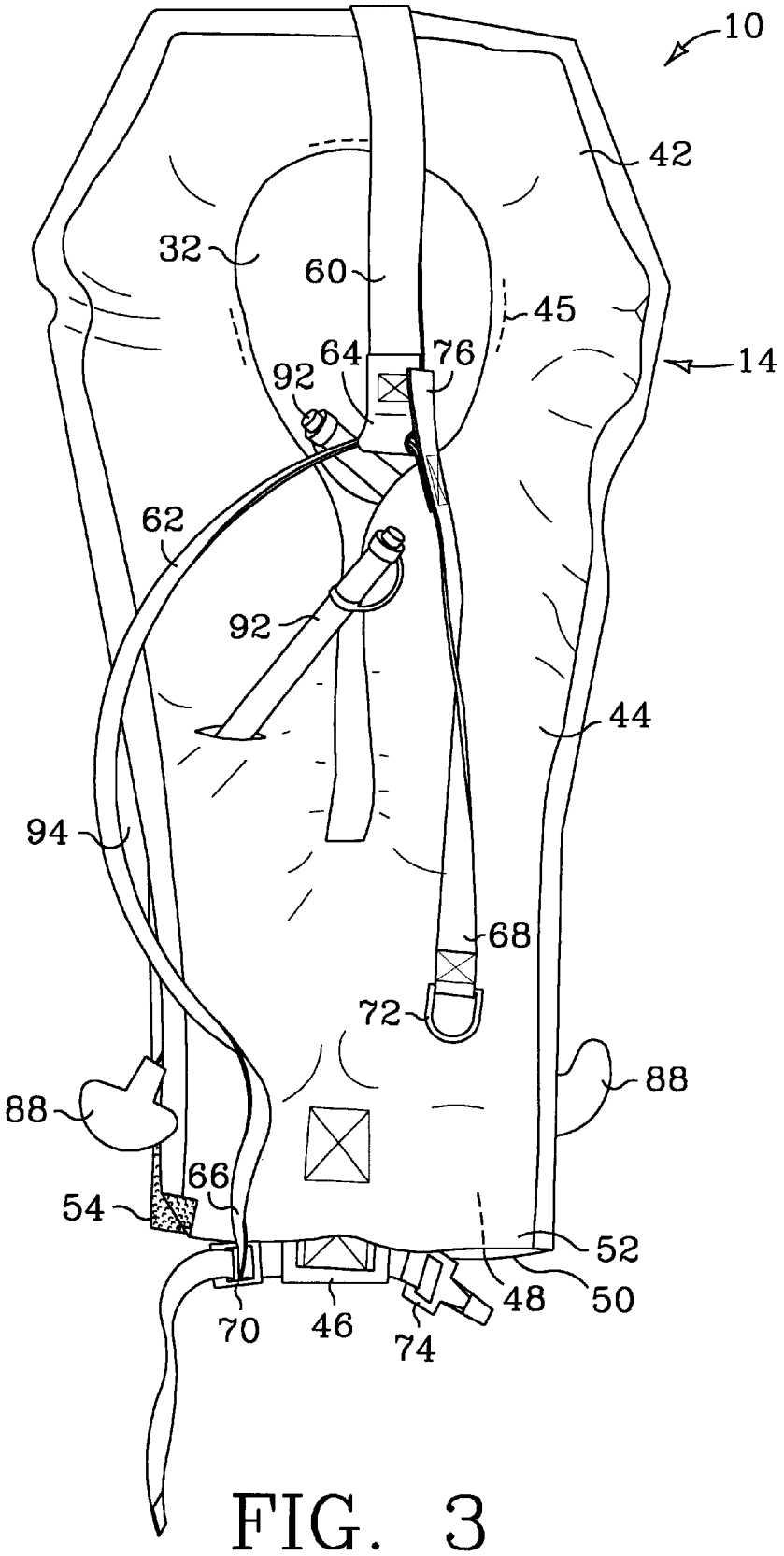
FIG. 3 is an elevation view of the personal flotation device of FIG. 1 uninflated showing the inflatable bladder enclosed within the cover and the harness unsecured.
Figure 5:
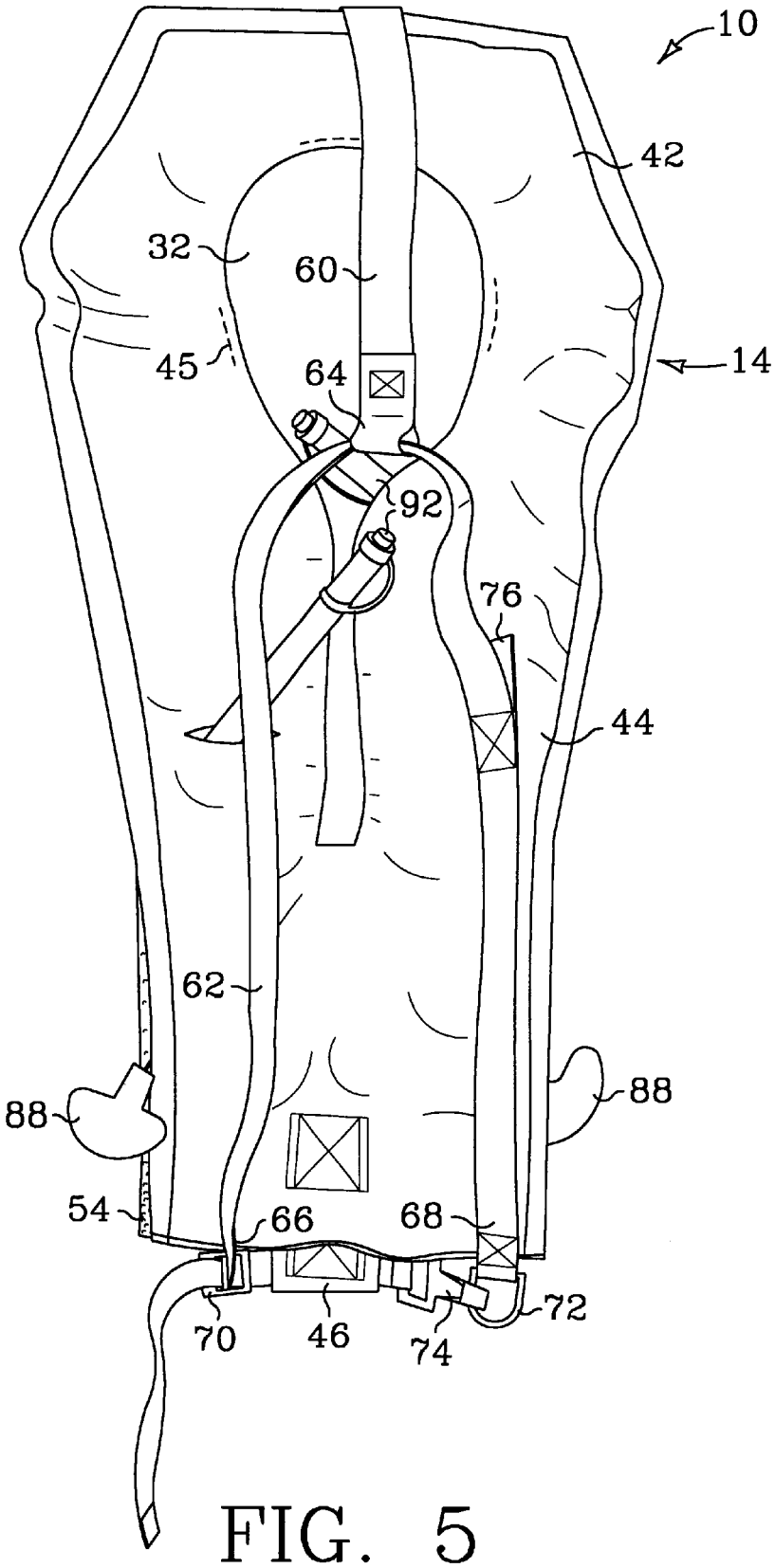
FIG. 5 is an elevation view of the personal flotation device of FIG. 1 uninflated showing the inflatable bladder enclosed within the cover and the harness secured.

When bladder 12 is not inflated, it is packed into and enclosed within cover 14 as shown in FIGS. 3 and 5. Referring to FIGS. 1–3, cover 14 is also generally U-shaped to enclose the uninflated bladder 12. Cover 14 includes a collar portion 42 and a chest portion 44. Collar portion 42 encloses bladder collar 20 and fits around and behind the user's head and neck when device 10 is being worn. Chest portion 44 encloses bladder chest panels 24 and 26 and extends down from collar portion 42 generally over the user's chest and mid-section when device 10 is being worn. As shown in FIG. 3, in this version of cover 14, chest portion 44 is split in to discrete panels only about half way down from collar portion 42. From that point to the bottom, cover 14 is a single panel or pocket that encloses both bladder chest panels 24 and 26. This configuration of cover 14 facilitates the release of bladder 12 as it inflates. The single pocket feature at the bottom of cover 14 affords a more robust attachment for harness 16, as discussed below.

Bladder 12 is secured to cover 14 at inside collar perimeter 28 and at the bottom of each chest panel 24, 26. It is desirable to minimize the points at which bladder 12 is secured to cover 14 so as not to impede the inflation and proper positioning of bladder 12 as it pops out of cover 14. Bladder flange 33 is sewn to cover 14 at three locations around the inside collar perimeter 28 as indicated by reference number 45 in the Figures. As shown in FIG. 2, bladder flange 33 is secured to cover 14 at the bottom of each chest panel 24, 26 through a short connector strap 47. The ends of strap 47 are sewn to flange 33 at the bottom of each chest panel 24, 26. The center of strap 47 is sewn into a base strap 46. Base strap 46 is sewn into both sides of cover 14 as indicated by the upper box X stitching shown in FIG. 2. In this way, the bottom of bladder chest portion 22 is secured to cover 14 while allowing each chest panel 24, 26 to inflate and expand out of cover 14 into the proper position.

Figure 8:
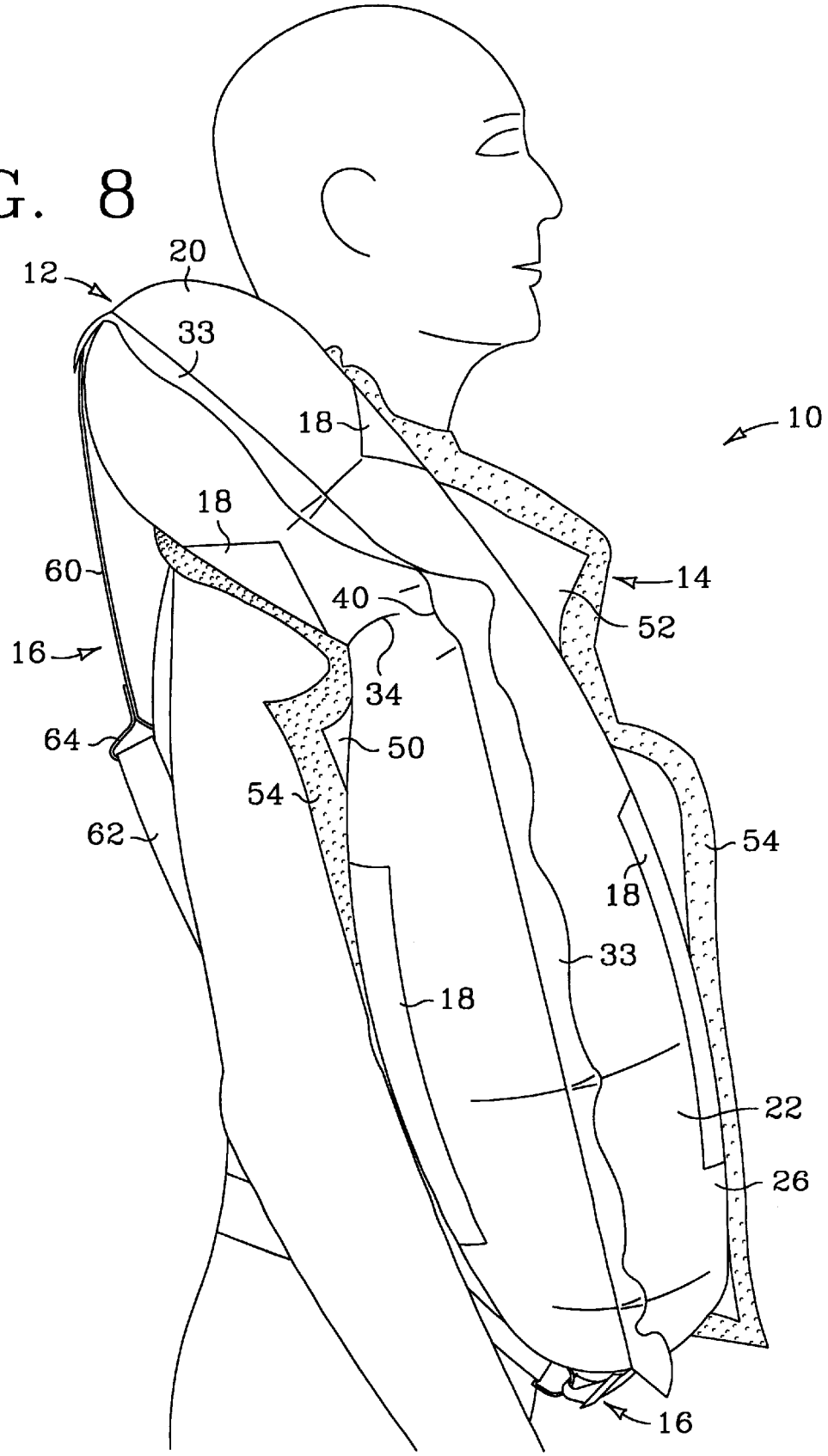
FIG. 8 is a side elevation view of the personal flotation device of FIG. 1 on a user.

Referring still to FIGS. 1–3, cover 14 defines an enclosure or pocket 48 (seen in FIG. 3) that holds the uninflated bladder 12. Pocket 48 is defined by the area between the two fabric panels 50 and 52 that comprise cover 14. (Panels 50 and 52 are also identified in FIGS. 7A and 7B.) The inside perimeter of panels 50 and 52 are sewn or otherwise permanently fastened together. If panels 50 and 52 are formed as an integral unit from a single piece of fabric, then the inside perimeter may be formed by simply folding the single piece of fabric. The outside perimeter of panels 50 and 52 are closed around the uninflated bladder 12 using hook and loop fastener strips 54 of material that adhere to one another when pressed together. Such material is commercially available under the name Velcro®. Other suitable releasable closures may be used. If Velcro® or a similar material is used, it is desirable to arrange the closure strips 54 facing one another as shown in FIGS. 3 and 8, rather than overlapping one another, to reduce the force necessary to separate the strips and allow the inflating bladder 12 to pop out of cover 14.

Figure 4:
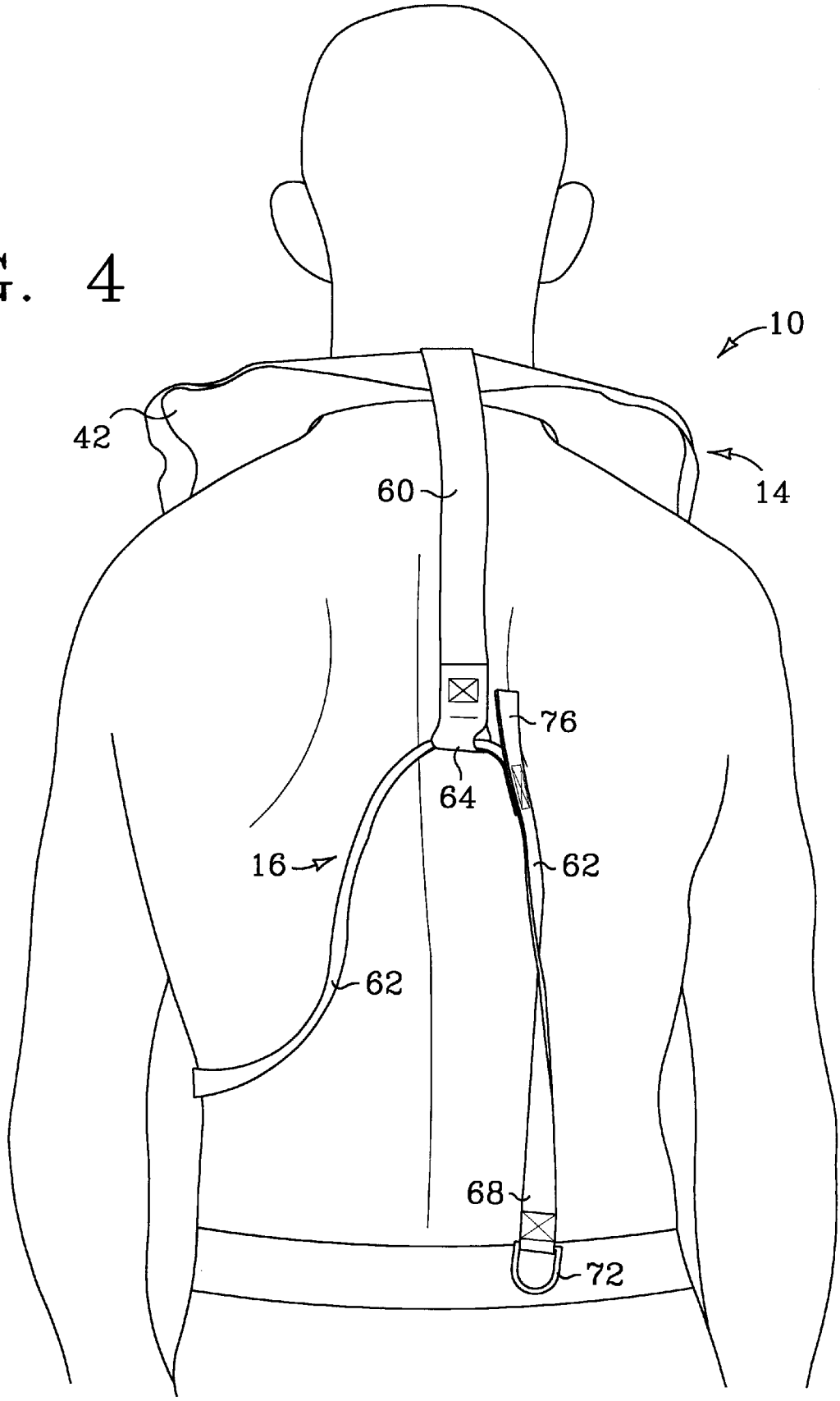
FIG. 4 is an elevation view of the personal flotation device of FIG. 3 donned by a user.
Figure 6:
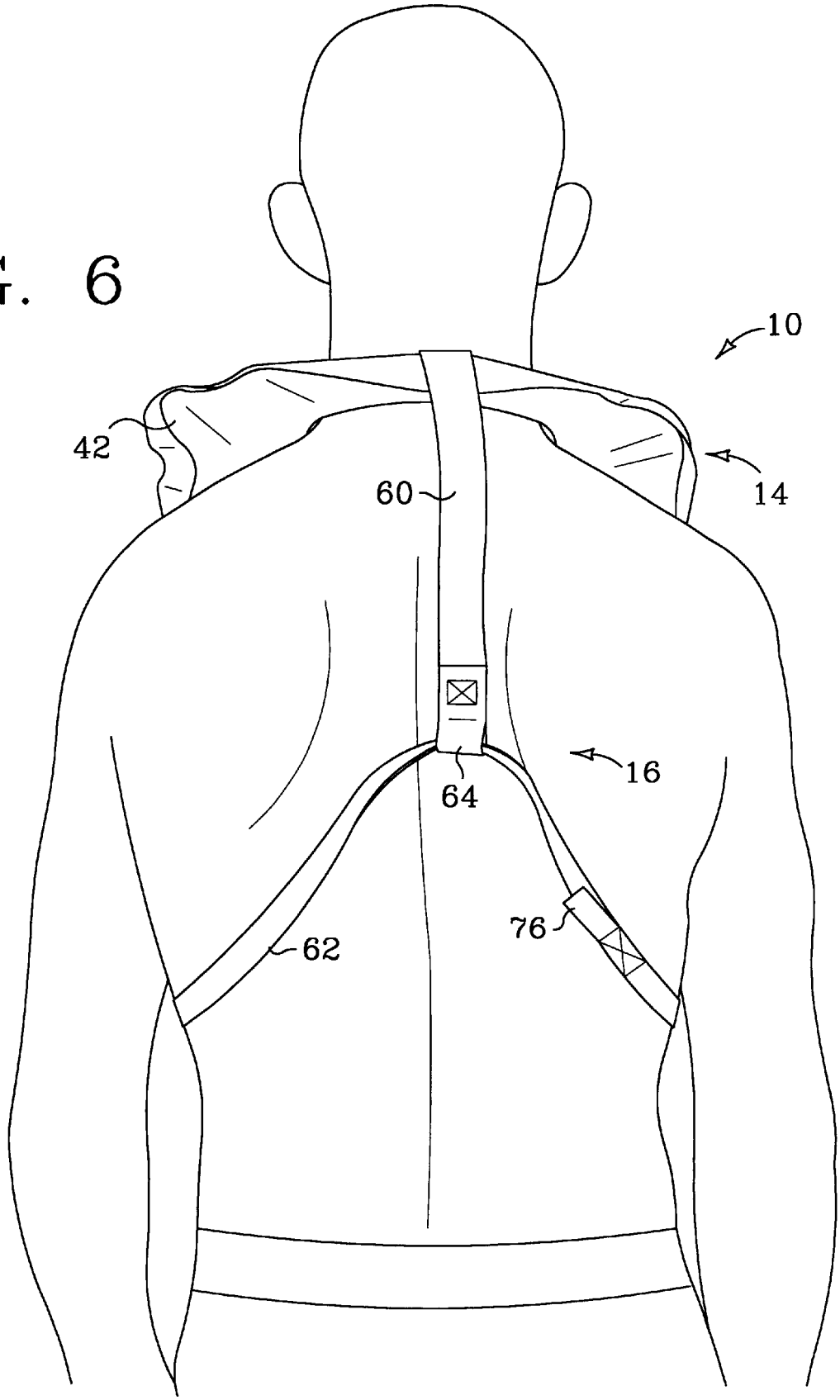
FIG. 6 is an elevation view of the personal flotation device of FIG. 5 donned by a user showing the harness secured.
Figure 10:
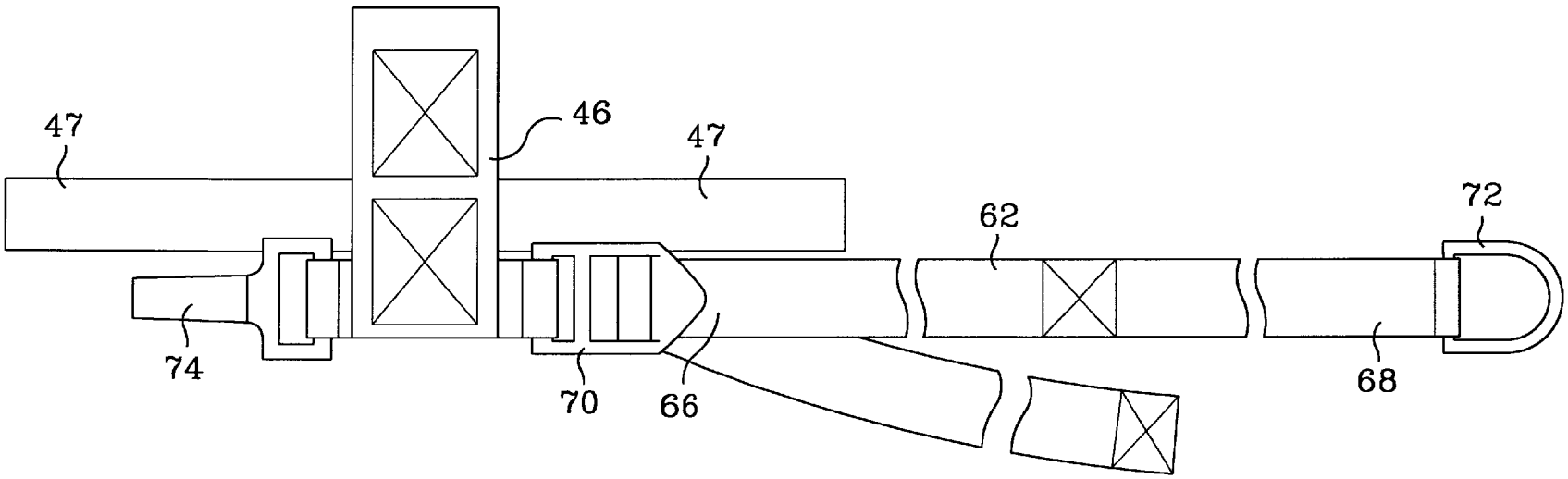
FIG. 10 is a detail view of a harness used in one embodiment of the invention.
Figure 11:
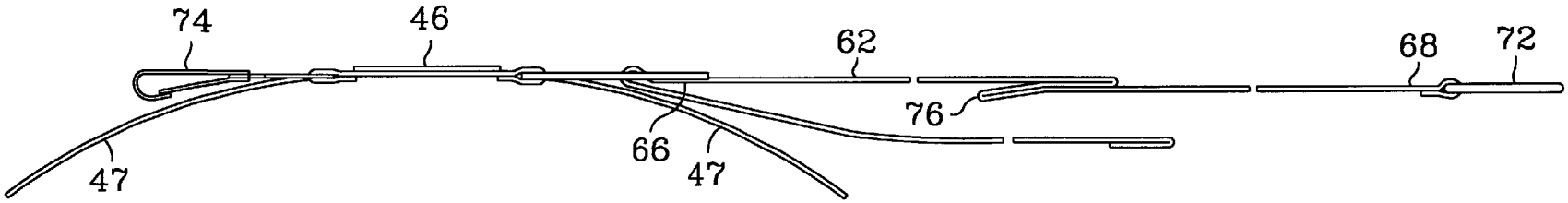
FIG. 11 is a side view of the strap of FIG. 10.

The components used to secure device 10 on the user will now be described with reference to FIGS. 3–6 and 10–11. FIGS. 3 and 4 show device 10 donned by the user but not secured. FIGS. 5 and 6 show device 10 donned and secured. FIGS. 10–11 are detail views of the harness and fastening components of device 10. Unlike conventional personal flotation devices that use a waist belt, the present invention uses a harness 16 to secure device 10 on the user. Harness 16 includes a first center strap 60 and a second cross strap 62. Center strap 60 is sewn or otherwise attached to flange 33 on the outside perimeter of bladder collar 20 at or near the centerline that divides the torso of the user into left and right sides. (This centerline is shown on FIG. 9.) Although center strap 60 does not have to be attached precisely at the centerline, it should be close enough to secure device 10 in the proper position on the user when harness 16 is fastened and pulled tight. Other configurations for the attachment of center strap 60 are possible. For example, the top portion of center strap 60 might be split into two straps attached to collar 20 on either side of the centerline. Such a Y shaped configuration functions in the same manner to secure device 10 in the proper position on the user when harness 16 is fastened and pulled tight.

A loop 64 is formed at the loose end of center strap 60. Although the exact length of center strap 60 is not critical, if it is too short, cross strap 62 will tend to ride up into the user's arm pits. Testing suggests that harness 16 will function best if it is long enough that, when hanging loose, it extends down into the area between the users shoulder blades. For most adult size personal flotation devices, therefore, center strap 60 should be 8"–12" long.

Cross strap 62 slides through loop 64 in center strap 60. Each end 66 and 68 of cross strap 62 is fastened or fastenable to the bottom of bladder 12. In the embodiment shown in the Figures, the first end 66 of cross strap 62 is fastened to the bottom of bladder 12 with a conventional buckle 70. Buckle 70 allows the user to lengthen and shorten cross strap 62 and thereby tighten and loosen device 10. The second end 68 of cross strap 62 is fitted with a hoop 72 that, in combination with clip 74, allows the user to fasten second end 68 to the bottom of bladder 12. A keeper 76 is sewn into or otherwise affixed to cross strap 62 below loop 64 in center strap 60. "Below" in this context refers to a flow from the first end 66 of cross strap 62 to the second end 68 of cross strap 62. Keeper 76 is positioned to keep a loose hanging second end 68 within easy reach of the user when the user puts on device 10. For most adult size personal flotation devices, therefore, keeper 76 should be positioned 12"–18" inches from second end 68 of cross strap 62. If webbing is used for cross strap 62, keeper 76 may be conveniently formed by making an S fold in the webbing material at the desired location and then sewing the fold down with, for example, box X stitching as shown in FIGS. 10 and 11.

Straps 60 and 62 are referred to collectively as harness 16 for convenience to describe the general position of the straps on the user. Harness 16 preferably is formed from discrete straps 60 and 62 as shown in the Figures. Alternatively, harness 16 might be constructed as a single strap in which case straps 60 and 62 would be portions of an integral unit. Other configurations of harness 16 are also possible.

For added strength and ease of manufacture, buckle 70 and clip 74 are not attached directly to the bottom of bladder 12. Rather, they are attached indirectly to bladder 12 through a heavy base strap 46 that is sewn into cover 14 and attached to bladder 12 through connector strap 47. As described above, the ends of connector strap 47 are sewn to flange 33 at the bottom of each bladder chest panel 24, 26 and the center of strap 47 is sewn into a base strap 46. In this way, all of the connections to the bottom of bladder 12 are made through base strap 46 at a common position that lies substantially on the centerline that divides the torso of the user into left and right sides and generally within the plane that extends through the edge perimeter of bladder 12.

Personal flotation device 10 includes two means for inflating bladder 12. The primary inflator 80, shown in FIG. 1, is a conventional compressed gas system. Primary inflator 80 includes a cartridge 82 of compressed gas (typically a $CO_2$ cartridge), a firing mechanism 84, lanyard 86 and grab handle 88. Firing mechanism 84 includes a firing pin and actuator (not shown) that pierces the seal on gas cartridge 82 when the user pulls on lanyard 86 to release gas into bladder 12. Inflator 80 is located within cover 14 along the inside perimeter near the bottom of chest panel 24, 26. Lanyard 86 runs through a guide 90 near the edge of cover 14 so that grab handle 88 protrudes from cover 14.

Preferably, device 10 includes two primary inflators 80. Each inflator 80 is located adjacent one another but on opposite chest panels 24, 26. Dual inflators 80 provide a back-up in case one fails and also gives the user a grab handle on both sides of device 10. As shown in FIGS. 3 and 5, grab handles 88 protrude from the sides of cover 14 generally within the plane that extends through the edge perimeter of bladder 12. As with other components of device 10, this positioning of grab handles 88 contributes to the reversibility of device 10—the grab handles will always be in the same position without regard to the orientation of device 10 on the user.

Referring to FIGS. 1, 2, 3 and 5, blow tubes 92 provide a secondary inflator. Each blow tube 92 is operatively coupled to bladder 12 and includes a valve (not shown) that allows the user to blow air into bladder 12 but prevents air from escaping bladder 12 unless the valve is held open. Two blow tubes are used to support the reversibility of device 10. Each tube 92 is located on opposite sides of device 10. Each tube 92 projects up from a chest panel 24, 26 on bladder 12 to a position near the mouth of the user when device 10 is being worn.

Referring to FIGS. 3–5, a large loop 94 is formed by center strap 60 and that portion of cross strap 62 above the intersection between the two straps at loop 64. The user dons device 10 by placing one arm through the large loop 94 and slipping his head through opening 32 as shown in FIGS. 3–4. The user can then reach back, grasp the loose end 68 of cross strap 62 and fasten hoop 72 into clip 74 as shown in FIGS. 5–6. Device 10 is tightened about the user by pulling end 66 of cross strap 62 through buckle 70. The positioning of center strap 60 and base strap 46 at the centerline of bladder 12 and within the central plane of bladder 12 allows the user to secure device 10 in the proper position without regard to the orientation of the device. Device 10 is truly reversible. Harness 16 flip flops back and forth from one side of device 10 to the other. Arm loop 94 is always in position for the user to slip his arm through to secure device 10 properly on the user.

When bladder 12 is inflated, the fabric walls of bladder 12 are taut. Pressuring collar 20 even slightly out of planar alignment with chest panels 24 and 26 allows the tension in the fabric walls of bladder 12 to pull collar 20 over to one side as bladder 12 bends at joints 34 and 36. Once collar 20 is tilted to one side, the tension in the fabric walls of bladder 12 acts to keep collar 20 tilted to that side. Due to the attachment of center strap 60 high on bladder collar 20, the inflating bladder 12 tightens harness 16 to better secure device 10 on the user. When the user puts on device 10 and tightens harness 16, center strap 60 pulls down on collar 20 so that when bladder 12 is inflated, collar 20 will automatically tilt towards the user's back, bending along joints 34 and 36 as shown in FIG. 8. This feature of the invention increases the "freeboard" of the jacket. Freeboard is the distance the jacket holds the wearer's face above the water. It has been observed that this feature increases the freeboard of adult size jackets by approximately 17%, from 4.25 inches to 5 inches.

Although the invention has been shown and described with reference to the foregoing preferred embodiment, various other embodiments of the invention are possible. It is to be understood, therefore, that these and other embodiments may be made without departing from the spirit and scope of the invention which is defined in the following claims.

What is claimed is:

1. A reversible inflatable personal flotation device, comprising:

an inflatable bladder comprising a collar configured to be worn about the neck of a user and an adjoining chest portion extending down from the collar generally over the user's chest and mid-section when the device is being worn, the chest portion extending from a top part adjoining the collar to a bottom part opposite the top part;

a first strap having a first end fastened to the collar of the bladder;

a second strap operatively connected to the first strap at a point generally between the user's shoulder blades when the device is being worn and the bladder is uninflated, the second strap extending from the bottom of the chest portion of the bladder up to the first strap and back down to the bottom of the chest portion of the bladder;

an inflator operatively coupled to the bladder; and wherein the first and second straps are discrete parts operatively coupled to one another.

2. A reversible inflatable personal flotation device, comprising:

an inflatable bladder comprising a collar configured to be worn about the neck of a user and an adjoining chest portion extending down from the collar generally over the user's chest and mid-section when the device is being worn, the chest portion extending from a top part adjoining the collar to a bottom part opposite the top part;

a first strap having a first end fastened to the collar of the bladder;

a second strap operatively connected to the first strap at a point generally between the user's shoulder blades when the device is being worn and the bladder is uninflated, the second strap extending from the bottom of the chest portion of the bladder up to the first strap and back down to the bottom of the chest portion of the bladder;

an inflator operatively coupled to the bladder; and wherein a first end of the second strap is fastened to the bottom of the chest portion and a second end of the second strap is releasably fastened to the bottom of the chest portion.

3. The device according to claim 2, wherein the operative connection between the first and second straps comprises the second strap slidable through a loop in the end of the first strap.

4. The device according to claim 3, further comprising a keeper on the second strap, the keeper configured to prevent the second strap from sliding back through the loop past the location of the keeper and the keeper located 12"–18" from the second end of the second strap.

5. The device according to claim 2, wherein the first end of the second strap or the second end of the second strap is adjustably fastened to the bottom of the chest portion such that the functional length of the second strap may be varied.

6. A reversible inflatable personal flotation device, comprising:

an inflatable bladder comprising a collar configured to be worn about the neck of a user and an adjoining chest portion extending down from the collar generally over the user's chest and mid-section when the device is being worn, the chest portion extending from a top part adjoining the collar to a bottom part opposite the top part;

a first strap having a first end fastened to the collar of the bladder;

a second strap operatively connected to the first strap at a point generally between the user's shoulder blades when the device is being worn and the bladder is uninflated, the second strap extending from the bottom of the chest portion of the bladder up to the first strap and back down to the bottom of the chest portion of the bladder;

an inflator operatively coupled to the bladder; and wherein the first and second straps are fastened to the bladder at locations generally within a plane that extends through the edge perimeter of the bladder.

7. A reversible inflatable personal flotation device, comprising:

an inflatable bladder comprising a collar configured to be worn about the neck of a user and an adjoining chest portion extending down from the collar generally over the user's chest and mid-section when the device is being worn, the chest portion extending from a top part adjoining the collar to a bottom part opposite the top part;

a harness fastened to the bladder at locations generally within a plane that extends through the edge perimeter of the bladder, the harness fastened to the bladder collar at a first location and to the bottom of one side of the bladder at a second location, and the harness releasably fastened to the bottom of the other side of the bladder at a third location, and the harness configured to secure the bladder on the user; and an inflator operatively coupled to the bladder.

8. The device according to claim 7, wherein the harness comprises a first strap having a first end fastened to the collar of the bladder and a second strap operatively connected to the first strap at a point generally between the user's shoulder blades when the device is being worn and the bladder is uninflated, the second strap extending from the bottom of one side of the chest portion of the bladder up to the first strap and back down to the bottom of the other side of the chest portion of the bladder.

9. A reversible inflatable personal flotation device, comprising:

an inflatable bladder comprising a collar configured to be worn about the neck of a user, an adjoining chest portion extending down from the collar generally over the user's chest and mid-section when the device is being worn, the collar having a curved inside perimeter that fits around the back of the user's neck and head when the device is being worn, the chest portion having a top adjoining the collar and a bottom, the bladder having a U-shaped outside perimeter extending along one side of the chest portion, around the collar and along the other side of the chest portion, a flexible joint between the collar and the adjoining chest portion, the collar movable back and forth when the device is inflated between a first position in which the joint flexes in a first direction and the collar tilts to one side and a second position in which the joint flexes in a second direction and collar tilts to the other side;

a harness configured to secure the bladder on the user; and an inflator operatively coupled to the bladder.

10. The device of claim 9, wherein the joint comprises a localized narrow region across the bladder at the transition from the chest portion to the collar.

11. A reversible inflatable personal flotation device, comprising:

an inflatable bladder comprising a collar configured to be worn about the neck of a user, an adjoining chest portion extending down from the collar generally over the user's chest and mid-section when the device is being worn, the collar having a curved inside perimeter that fits around the back of the user's neck and head when the device is being worn, the chest portion having a top adjoining the collar and a bottom, the bladder having a U-shaped outside perimeter extending along one side of the chest portion, around the collar and along the other side of the chest portion, a localized narrow region across the bladder at the transition from the chest portion to the collar;

a harness configured to secure the bladder on the user;

an inflator operatively coupled to the bladder; and wherein each localized narrow region is defined by a rounded indentation of the outside perimeter of the bladder at the transition from the chest portion of the bladder to the bladder collar.

12. A reversible inflatable personal flotation device, comprising:

a generally U-shaped inflatable bladder comprising a collar configured to be worn about the neck of a user and adjoining chest portions extending down from the collar generally over the user's chest and mid-section when the device is being worn;

a first strap having a first end and a second end, the first end fastened to the bladder collar at a location that lies substantially on a centerline that divides the torso of the user into left and right sides and the second end comprising a loop disposed 8"–12" from the first end;

a second strap extending from the bottom of the chest portion of the bladder up through the loop on the second end of the first strap and back down to the bottom of the chest portion of the bladder, the second strap having a first end fastened to the bottom part of the chest portion of the bladder and a second end releasably fastened to the bottom part of the chest portion of the bladder;

wherein the first and second straps are fastened to the bladder at locations generally within a plane that extends through an edge perimeter of the bladder;

a keeper disposed on the second strap 12"–18" from the second end of the strap, the keeper configured to prevent the second strap from sliding back through the loop past the location of the keeper; and an inflator operatively coupled to the bladder.

13. The device according to claim 12, further comprising a cover defining a generally U shaped enclosure configured to hold the uninflated bladder, the enclosure characterized by two fabric panels permanently fastened together along an inside perimeter of the bladder and releasably fastened along an outside perimeter of the bladder.

14. The device according to claim 13, further comprising mating strips of material that adhere to one another when pressed together disposed on an inside surface along an outside perimeter of the cover panels, the mating strips of material being so disposed to releasably fasten together the outside perimeter of the two cover panels.

15. The device according to claim 12, wherein the inflator comprises:

first and second cartridges of compressed gas disposed on opposite sides of the bladder;

a user operated cartridge firing mechanism operatively coupled between each cartridge and the bladder, the firing mechanisms operable between a first position in which gas is retained in the cartridge and a second position in which gas is expelled from the cartridge into the bladder; and a grab handle coupled to each firing mechanism for activating the firing mechanism to move from the first position to the second position, each grab handle disposed adjacent to the bladder generally in a plane that extends through the edge perimeter of the bladder.

16. The device according to claim 12, wherein the bladder includes a flexible joint between the collar and the adjoining chest portion, the collar movable back and forth when the device is inflated between a first position in which the joint flexes in a first direction and the collar tilts to one side and a second position in which the joint flexes in a second direction and collar tilts to the other side.

17. The device according to claim 16, wherein the joint comprises a localized narrow region defined by rounded indentations in the outside perimeter of the bladder at the transitions from the chest portion of the bladder to the bladder collar.

* * * * *